US009592647B2

(12) United States Patent
Chan et al.

(10) Patent No.: US 9,592,647 B2
(45) Date of Patent: Mar. 14, 2017

(54) MODULAR CORRUGATED CONTAINER HAVING INTEGRATED CUSHIONING

(71) Applicant: Dell Products L.P., Round Rock, TX (US)

(72) Inventors: Mun-Yee Chan, Austin, TX (US); Oliver F. Campbell, Austin, TX (US); Ji Yeon Lee, Round Rock, TX (US); Abelia M. Sloey, Cedar Park, TX (US); Tyler Ray Buttrill, Round Rock, TX (US); Kate Chouinard, Boulder, CO (US)

(73) Assignee: DELL PRODUCTS L.P., Round Rock, TX (US)

( * ) Notice: Subject to any disclaimer, the term of this patent is extended or adjusted under 35 U.S.C. 154(b) by 118 days.

(21) Appl. No.: 14/449,396

(22) Filed: Aug. 1, 2014

(65) Prior Publication Data

US 2016/0031626 A1 Feb. 4, 2016

(51) Int. Cl.

| | |
|---|---|
| ***B65D 81/07*** | (2006.01) |
| ***B65D 5/50*** | (2006.01) |
| ***B31D 5/00*** | (2006.01) |

(52) U.S. Cl.

CPC ..... *B31D 5/0004* (2013.01); *B65D 5/505* (2013.01); *B65D 5/503* (2013.01); *B65D 5/5035* (2013.01)

(58) Field of Classification Search

USPC ..... 206/592, 591, 784, 523, 524, 583, 521; 53/472

See application file for complete search history.

(56) References Cited

U.S. PATENT DOCUMENTS

| | | | | | |
|---|---|---|---|---|---|
| 1,925,298 | A * | 9/1933 | Boeye | B65D 5/441 | 206/591 |
| 3,161,339 | A * | 12/1964 | Weller | B65D 5/5028 | 206/521 |
| 3,221,973 | A * | 12/1965 | Kalbrener | B65D 5/5033 | 206/586 |
| 4,221,294 | A * | 9/1980 | Burgess | B65D 5/28 | 206/521 |
| 5,251,760 | A * | 10/1993 | Smith | B65D 5/5028 | 206/583 |
| 5,323,896 | A * | 6/1994 | Jones | B65D 5/5028 | 206/223 |

(Continued)

*Primary Examiner* — J. Gregory Pickett
*Assistant Examiner* — Gideon Weinerth
(74) *Attorney, Agent, or Firm* — Terrile, Cannatti, Chambers & Holland, LLP; Robert W. Holland

(57) ABSTRACT

A modular corrugated container integrates product cushioning with a product support surface formed from corrugated paper and having features that absorb transverse accelerations. The support surface has scored tabs that bend perpendicular to an interior support portion, forming feet that elevate the interior portion relative to a container bottom. The interior portion has perforations that absorb accelerations, such as a perforations formed around the outside perimeter of the location at which a product rests, perforations extending from corners of the support surface towards a central location of the support surface, and perforations at the scoring of the tabs. Voids formed along the tabs remove portions of the feet from contact with the container bottom to encourage constant dissemination of accelerations across the support surface.

13 Claims, 12 Drawing Sheets

(56) References Cited

U.S. PATENT DOCUMENTS 5,335,846 A * 8/1994 Smith ..... B65D 77/02 206/594
5,676,245 A * 10/1997 Jones ..... B65D 5/5028 206/223
5,823,352 A * 10/1998 Mena ..... B65D 5/4204 206/586
5,894,932 A * 4/1999 Harding ..... B65D 81/075 206/583
5,967,327 A * 10/1999 Jones ..... B65D 81/075 206/466
6,073,761 A * 6/2000 Jones ..... B65D 5/5028 206/223
6,158,589 A * 12/2000 Smith ..... B65D 81/07 206/466
6,302,274 B1 * 10/2001 Ridgeway ..... B31B 11/00 206/583
6,305,539 B1 * 10/2001 Sanders, Jr. ..... B65D 5/6664 206/320
6,997,323 B2 * 2/2006 Maresh ..... B65D 5/5069 206/486
7,086,534 B2 * 8/2006 Roesel ..... B65D 5/5028 206/583
7,290,662 B2 * 11/2007 Lofgren ..... B65D 5/5028 206/583
7,882,956 B2 * 2/2011 McDonald ..... B65D 5/5059 206/583
7,918,339 B2 * 4/2011 Kashiwabara ..... B65D 5/5028 206/583
8,307,984 B1 * 11/2012 Collier ..... B65D 81/05 206/591
8,727,123 B1 * 5/2014 Roberts ..... B65D 81/075 206/521
D706,136 S * 6/2014 Roberts ..... D9/456
8,875,889 B2 * 11/2014 Smith ..... B65D 81/052 206/521
2003/0102244 A1 * 6/2003 Sanders, Jr. ..... B65D 5/22 206/523
2004/0140243 A1 * 7/2004 Roesel ..... B65D 5/5028 206/583
2004/0178113 A1 * 9/2004 Lofgren ..... B65D 5/5028 206/583
2006/0102515 A1 * 5/2006 McDonald ..... B65D 5/5059 206/583
2007/0284281 A1 * 12/2007 Shimazu ..... B65D 5/5035 206/592
2009/0188833 A1 * 7/2009 Klos ..... B65D 5/5213 206/583
2010/0000907 A1 * 1/2010 Kashiwabara ..... B65D 5/5028 206/592
2010/0187149 A1 * 7/2010 Tsukii ..... B65D 5/505 206/521
2010/0320112 A1 * 12/2010 Kasiwabara ..... B65D 5/5035 206/461
2011/0240515 A1 * 10/2011 Ridgeway ..... B65D 5/5028 206/583
2012/0272621 A1 * 11/2012 Miyazaki ..... B65D 5/5035 53/452
2012/0273386 A1 * 11/2012 Miyazaki ..... B65D 5/12 206/591
2014/0183097 A1 * 7/2014 LeRoy ..... B65D 75/305 206/583

* cited by examiner

MODULAR CORRUGATED CONTAINER HAVING INTEGRATED CUSHIONING

BACKGROUND OF THE INVENTION

Field of the Invention

The present invention relates in general to the field of product packaging, and more particularly to a modular corrugated container having integrated cushioning.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems come in a variety of sizes and weights. In response to market demands, portable information handling systems have shrunk in size and weight by squeezing smaller and more capable components into housings of decreased size. One difficulty that arises with lighter weight and thinner housings is that smaller accelerations can cause greater flexures, leading to breakage at the circuit board or other components in the housing. In particular, large sudden accelerations applied at a housing during shipping can result in bending of the housing if the edges of the housing have greater support than the middle of the housing.

Conventional packaging of an information handling system typically involves supports designed into corrugated cardboard material that fit a particular housing. Designing packaging to fit each information handling system product can involve long packaging development times, thus adding to product costs. System-specific packaging creates an inventory problem of matching system orders to packaging orders and storing system-specific packaging at manufacture locations in adequate but not excessive quantities. Although each information handling system may have a corrugated package designed to fit the system housing, the individual packaging designs tend to follow common guidelines that tend to result in greater amounts of corrugated material in each package design than may be needed. These guidelines may added additional materials to offset variations in packaging material qualities available in different regions. Excess packaging material has an undue environmental impact and creates a disposal problem for the customer. Excess packaging material also impacts logistics by increasing the amount of pallet space that each package consumes and the weight of each package. Since packages are often shipped by air, small incremental decreases in package size and weight may have a substantial combined impact when loaded into an aircraft.

Ultimately, packaging success for an information handling system or other product depends upon safe arrival of a package to a customer. Safe arrival depends upon adequate exterior strength to allow stacking of packages during shipping and adequate interior strength to keep the packaged product from harm in the event of excessive accelerations, such as dropping of the package. Increasing the amount of packaging material used to build the exterior of the packaging tends to increase stack strength but also increases the footprint of the package. Increasing internal packaging components can improve interior strength, but often result in foam and other cushioning materials added to the interior of the packaging. For example, foam cushion end-cap designs fit around the perimeter of an information handling system housing and are intended to protect the housing from side impacts and to cushion the housing during vertical accelerations. A typical end-cap design fits onto the corners of the information handling system housing to protect the central regions of the information handling system housing from impact; however, the lack of support in the central region of the housing can result in flexing under high accelerations that can damage internal circuit boards and components.

SUMMARY OF THE INVENTION

Therefore a need has arisen for a system and method which packages products to protect against damage using corrugated material shaped to cushion the impact of accelerations passing through the packaging to the product.

In accordance with the present invention, a system and method are provided which substantially reduce the disadvantages and problems associated with previous methods and systems for packaging a product in corrugated material. A modular corrugated container has integrated cushioning to absorb accelerations applied to the product in the container. A support surface formed of perforated corrugated material aids translation of transverse accelerations as a constant across the product to reduce product flexure in response to the accelerations.

More specifically, a corrugated container to ship a portable information handling system includes a support surface on which the portable information handling system rests. The support surface has tabs scored along an outer edge, the tabs bending perpendicular to the support surface to form feet that rest on the container bottom surface to hold the support surface in an elevated position. The tabs have voids formed so that portions of the feet contact the bottom surface while other portions do not. In addition, the tabs include perforations along the score so that the voids and cuts from the perforations coordinate to aid dissemination of accelerations applied to the product in a constant manner that reduces product flexure. A perforation is formed in the support surface that is substantially collocated with the information handling system perimeter, such as in a shape that parallels the shape of the information handling system. Additional perforations formed in the support surface aid cushioning of the information handling system by the support surface under the influence of accelerations, such as perforations cut diagonally from each corner of a rectangular shaped support surface towards a central position of an internal portion of the support surface.

The present invention provides a number of important technical advantages. One example of an important technical advantage is that information handling system housings built to have reduced weight and size are adequately reinforced by packaging during transport to reduce flexure under accelerations. Packaging development times are reduced with a readily adapted form that is optimized on a product-by-product basis. The amount of packaging material needed for a given level of product protection is reduced relative to conventional packaging, and the use on less-readily recycled materials, such as foam, is reduced. Packages for a given level of product protection take up less space than conventional packaging with increased stack strength so that pallet room and weight is reduced per package and product height stacking is increased, thus allowing more efficient use of transport resources, such as aircraft pallet room. Another example is that the container provides a symmetrical solution so that an information handling system is protected equally whether placed with its front or rear at the front of the container. Further, the geometry of the lower and upper supports is the same, so that manufacture and use of the supports is less complex and less costly. For instance, the bottom support is simply place upside down at the top of the container to provide the same level of protection to the product placed in the container whether the product is oriented up or down.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

.A negative edge modular container for shipping portable information handling systems has a pair of top and bottom corrugated material trampoline-like cushions with regulated deflection to limit excessive flexure of an information handling system housing in response to accelerations. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
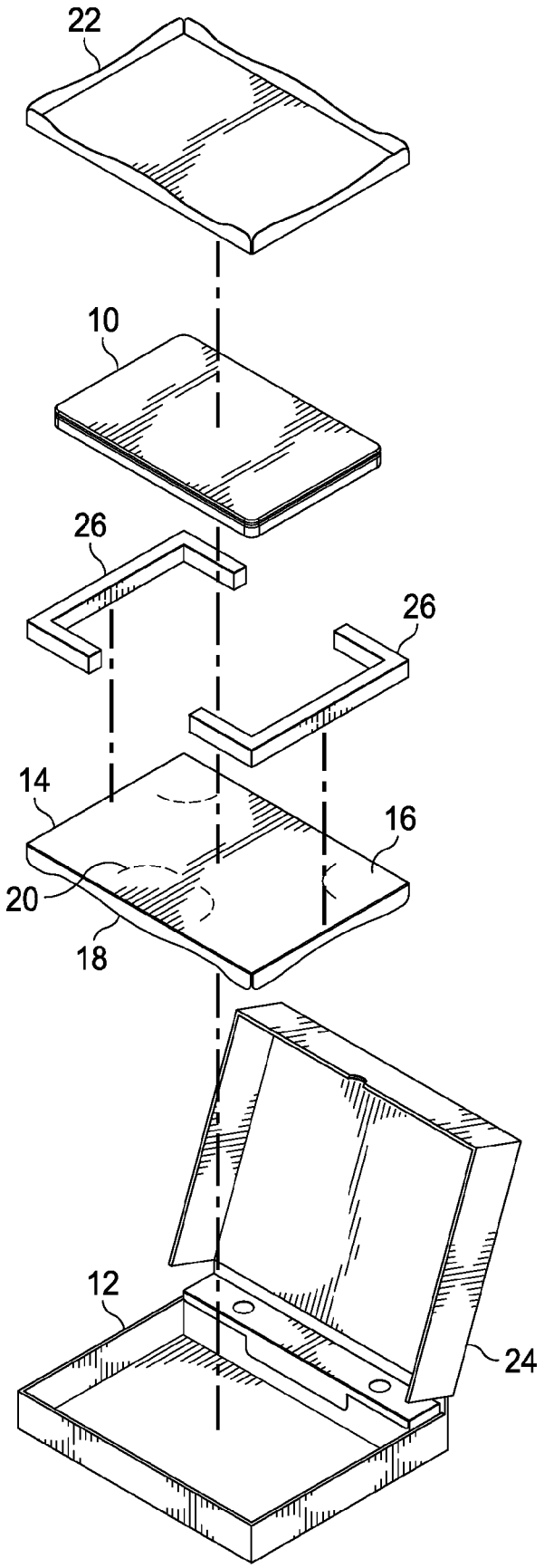
FIG. 1 depicts a blown-up view of a system for supporting a portable information handling system in a container.

Referring now to FIG. 1, a blown-up view depicts a system for supporting a portable information handling system 10 in a container 12. Portable information handling system 10 is, for example, a laptop, tablet or other device that processes information with a processor and stores information with a memory. In alternative embodiments, other types of information handling systems and other types of products may be shipped. Container 12 is, for example, a corrugated cardboard box or other type of shipping container made from other types of materials. The interior of container 12 is sized to accept a support 14 that provides a support surface 16 on which portable information handling system 10 rests. In the example embodiment, information handling system 10, container 12 and support 14 each have a generally rectangular shape; however in alternative embodiments, products disposed in container 12 may have alternative shapes that container 12 and support 14 may or may not adopt.

In the example embodiment of FIG. 1, support 14 has tabbed feet 18 formed by bending material of support 14 along a score. For example, support 14 is cut from corrugated cardboard or other corrugated material and scored to define bending locations for forming tabbed feet 18. Tabbed feet 18 are bent substantially 90 degrees to contact the bottom surface of container 12 and raise support surface 16 relative to container 12. One or more perforations 20 formed in support surface 16 and support 14 promotes constant distribution of accelerations across support surface 16 so that even support is provided to information handling system 10. In the example embodiment, an inverted support 22 having a similar structure to support 14 provides constant distribution of accelerations that are directed between a container lid 24 and information handling system 10. When information handling system 10 is placed between support 14 and inverted support 22, it is held in position by foam cushions 26, which rest between information handling system 10 and the side walls of container 12. In alternative embodiments, alternative positioning devices may be used to hold information handling system 10 in place.

Figure 2:
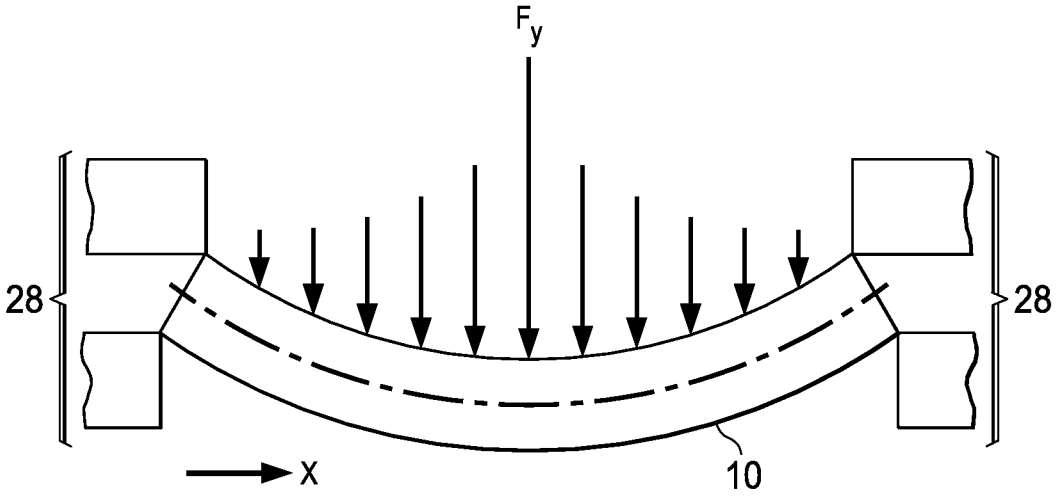
FIG. 2 depicts a side view of flexure induced at an information handling system supported in the container with end caps.

Referring now to FIG. 2, a side view depicts flexure induced at an information handling system 10 supported in the container with end caps 28. A transverse force $F_Y$ is introduced at the container, such as by a dropping of the container. End caps 28 maintain each end of information handling system 10 substantially in place, however, the weight of information handling system 10 distributed between end caps 28 causes deflections at the housing of information handling system 10. Flexure at the housing can translate into internal components, such as circuit boards, that can experience damage and failure.

Figure 3:
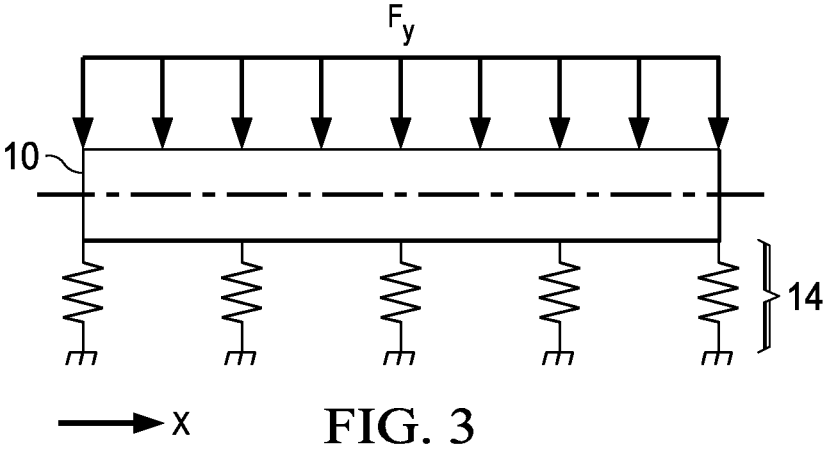
FIG. 3 depicts a side view of an example of constant support across an information handling system with a corrugated material support.

Referring now to FIG. 3, a side view depicts an example of constant support across an information handling system 10 with a corrugated material support 14. Support 14 has a footprint that supports and encompasses the entire product unit's surface area. Constant support across the product surface area prevents and/or reduces deflection with the sag and bow response found in end cap packaging. By absorbing transverse accelerations at the Y-axis with a "trampoline" effect of the support 14, deflection or flexure in the X-axis is reduced or kept constant in the X-axis across the plane of the product held by support surface 16. An innate holistic suspension system is provided with minimal corrugated material. The constant deflection provided by the support surface means high G-levels can be accepted at container 12 because bending of information handling system 10's housing is reduced under the influence of accelerations. Support surface 16's trampoline-like cushion effect encompass the entire information handling system housing area to provide a constant an evenly-distributed force.

To obtain the trampoline cushion effect, cut-outs, scores and perforations are added to corrugate paper material that provides a desired deflection and unit input G-level. Cut-outs, scores and perforations for particular product are deduced by testing in various configurations and adopting a configuration that provides acceptable results. Features of a support 14 are tuned with different lengths, perimeters and cut sizes so that dynamic behavior and response are achieved on the application of accelerations. FIGS. 4-9 describe an iterative process for testing various features added to a support 14 for a product by adding features and testing the acceleration response. Alternative products might have different iterations to arrive at a desired acceleration response. Thus, alternative features to provide a trampoline cushion effect fall within the intended scope of the present disclosure.

Figure 4A:
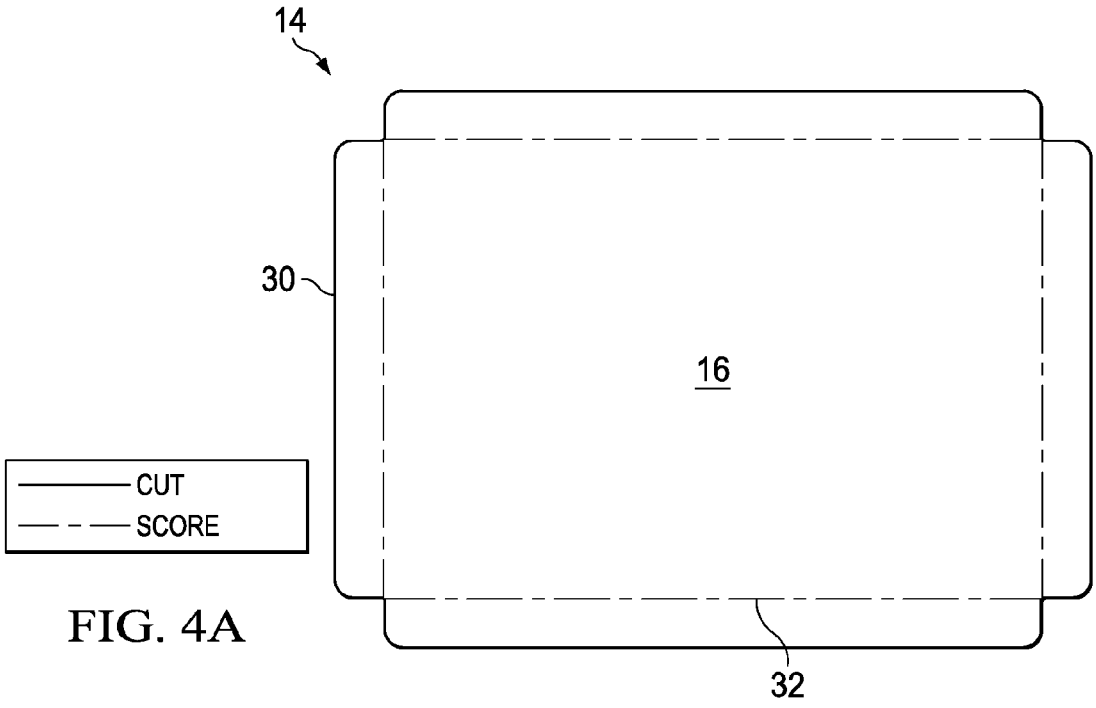
FIGS. 4A and 4B (generally referred to herein as FIG. 4) depict an example of a support formed from corrugated material and the acceleration response at the support.
Figure 4B:
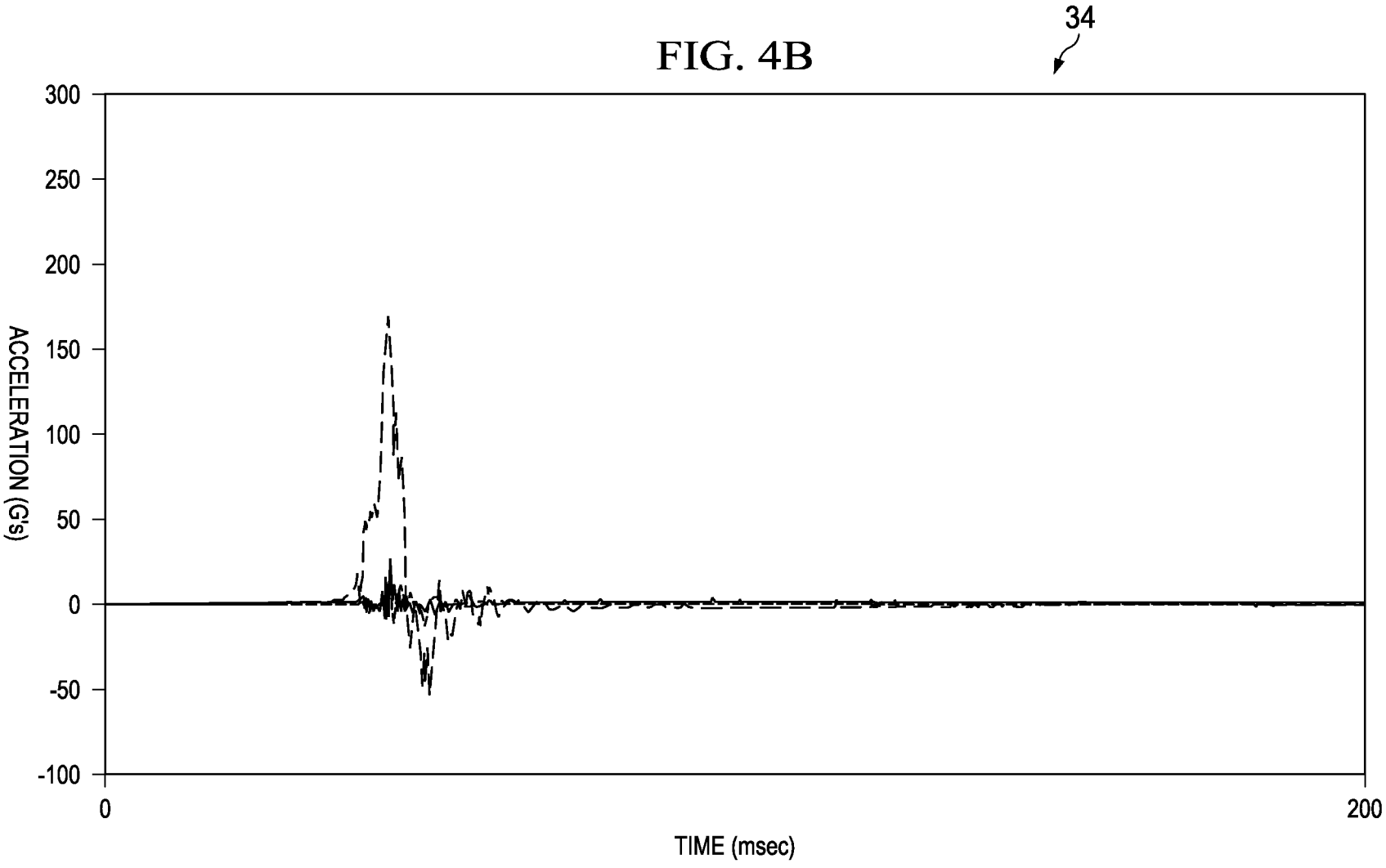

Referring now to FIG. 4, an example is depicted of a support formed from corrugated material and the acceleration response at the support. Support 14 is cut from corrugated paper to have a tab 30 on each side of a rectangle shaped support surface 16. A score 32 is made along each tab 30 at its intersection with support surface 16 so that the tabs 30 are readily bent into feet to hold support surface 16 raised above the container bottom. In the example embodiment, a score is made by pressing against the corrugated material without cutting the corrugated material. In alternative embodiments, perforations or cuts may be used through part or all of the corrugated material thickness. Acceleration chart 34 depicts accelerations detected at an information handling system disposed on support surface 16 as configured in FIG. 4. For example, a container 12 is dropped from a defined height with an information handling system 10 resting on a support surface 16 with tabs 30 bent into feet, and an accelerometer coupled to information handling system 10 to measure accelerations. As is depicted by acceleration chart 34, a top acceleration of approximately 175 G's is detected with the support surface 16 of FIG. 4.

Figure 5A:
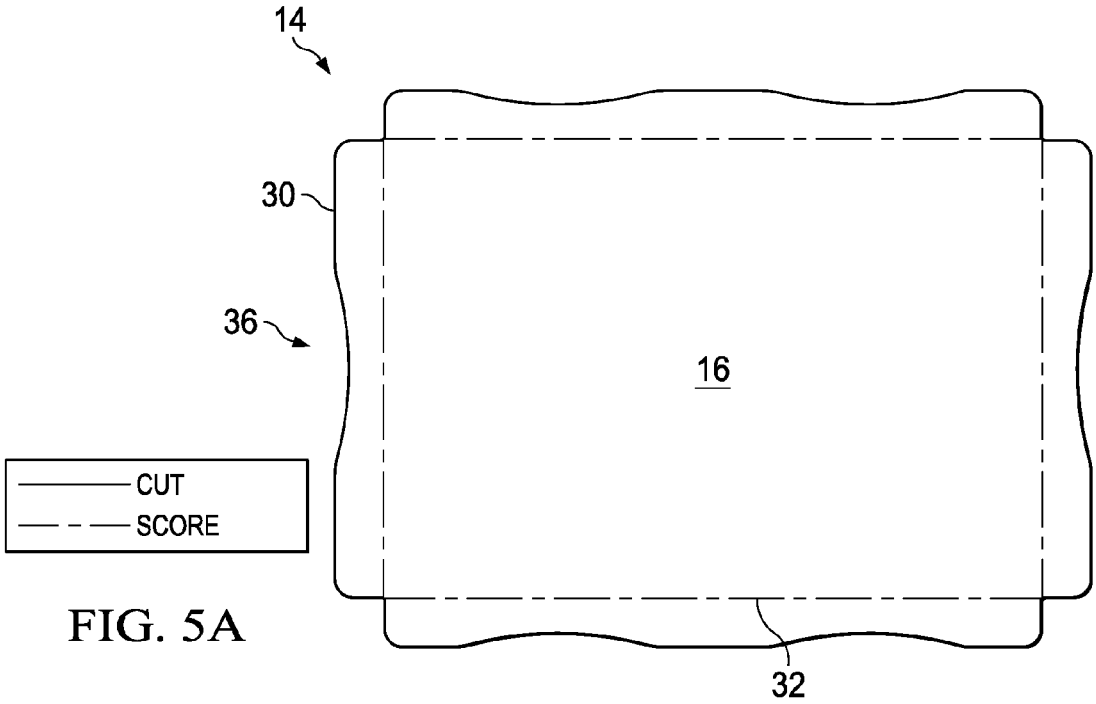
FIGS. 5A and 5B (generally referred to herein as FIG. 5) depict an example of a support having tab feet and the acceleration response at the support.
Figure 5B:
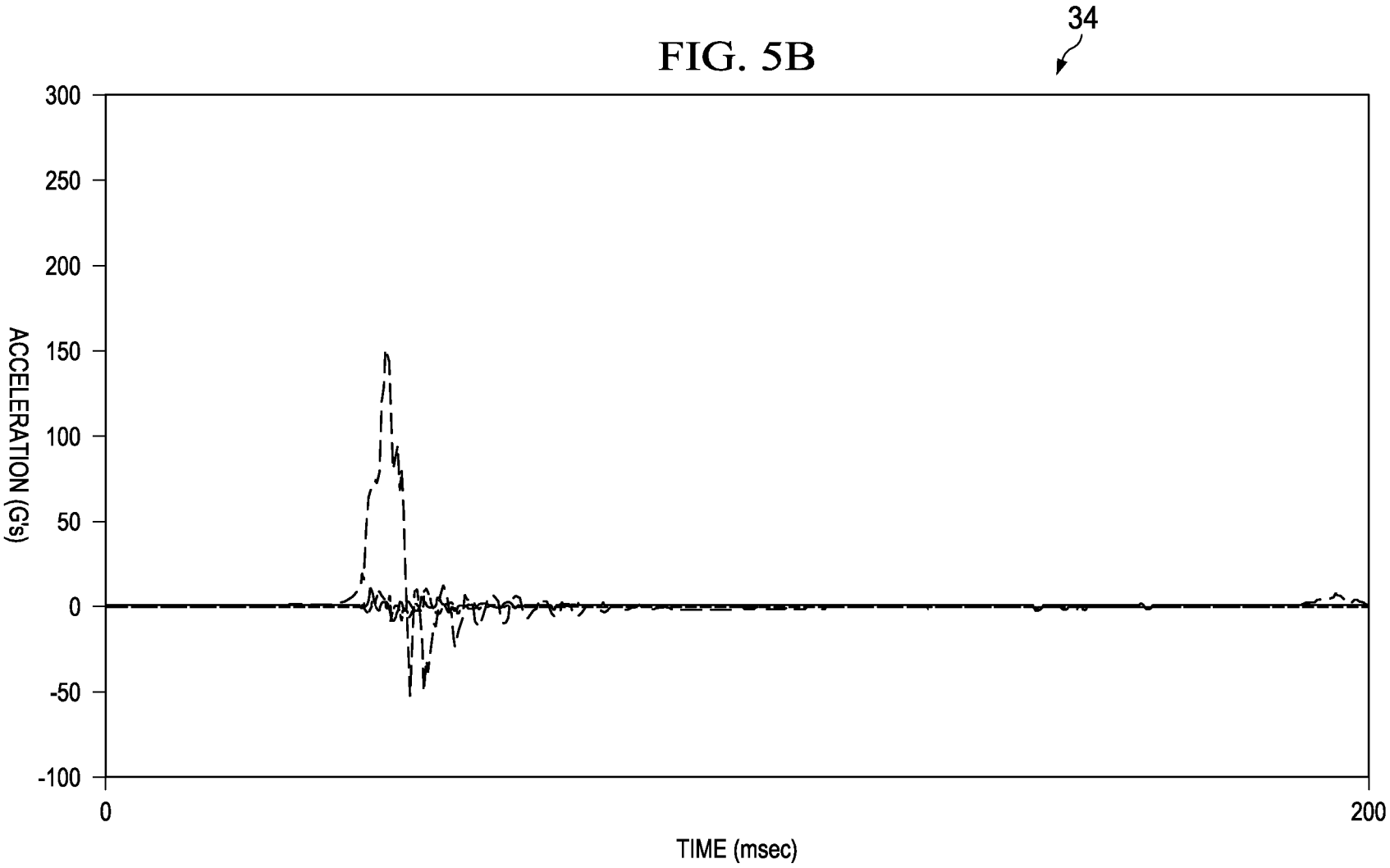

Referring now to FIG. 5, an example is depicted of a support having tab feet and the acceleration response at the support. In the example embodiment of FIG. 5, a void 36 is cut from each tab 30 so that at least part of the tabbed feed will not contact the bottom of the container 12. The voids are cut in a symmetrical pattern that leaves a void across the center of the rectangle sides having the shortest length and has contact at the center point of the rectangle sides having the greater length. The voids aid in the distribution of acceleration forces across support surface 16 so that a maximum acceleration of approximately 150 G's is experienced at information handling system 10.

Figure 6A:
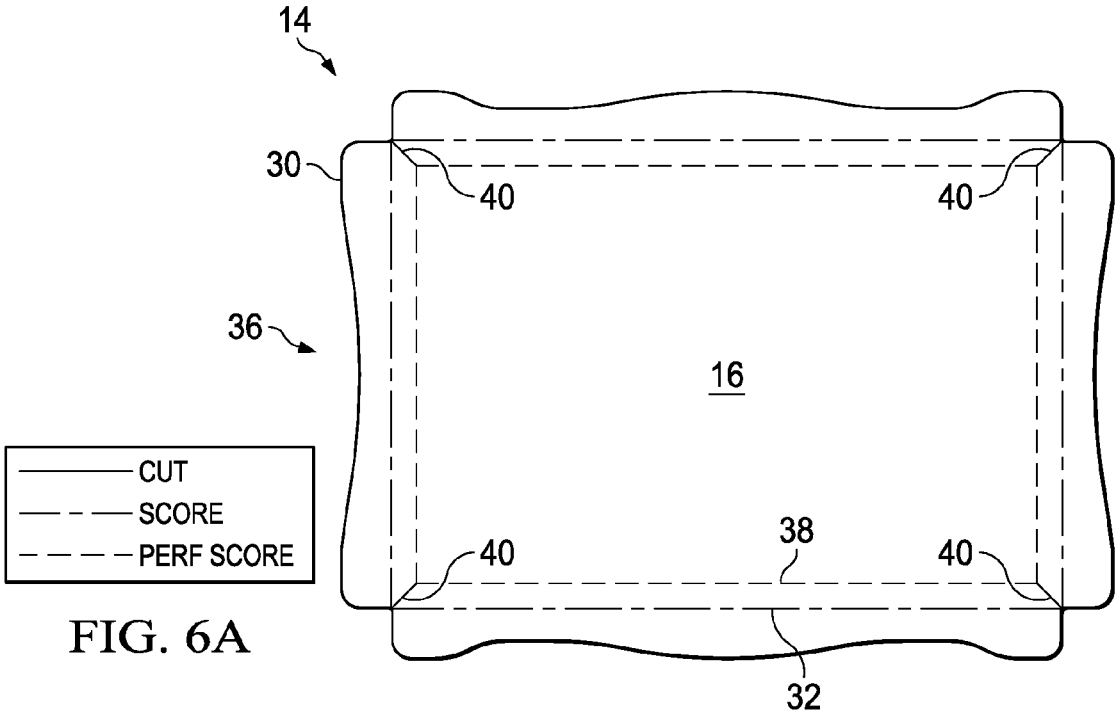
FIGS. 6A and 6B (generally referred to herein as FIG. 6) depict an example of a support having tabbed feet symmetrical perforations at the perimeter of a supported device and the acceleration response at the support.
Figure 6B:
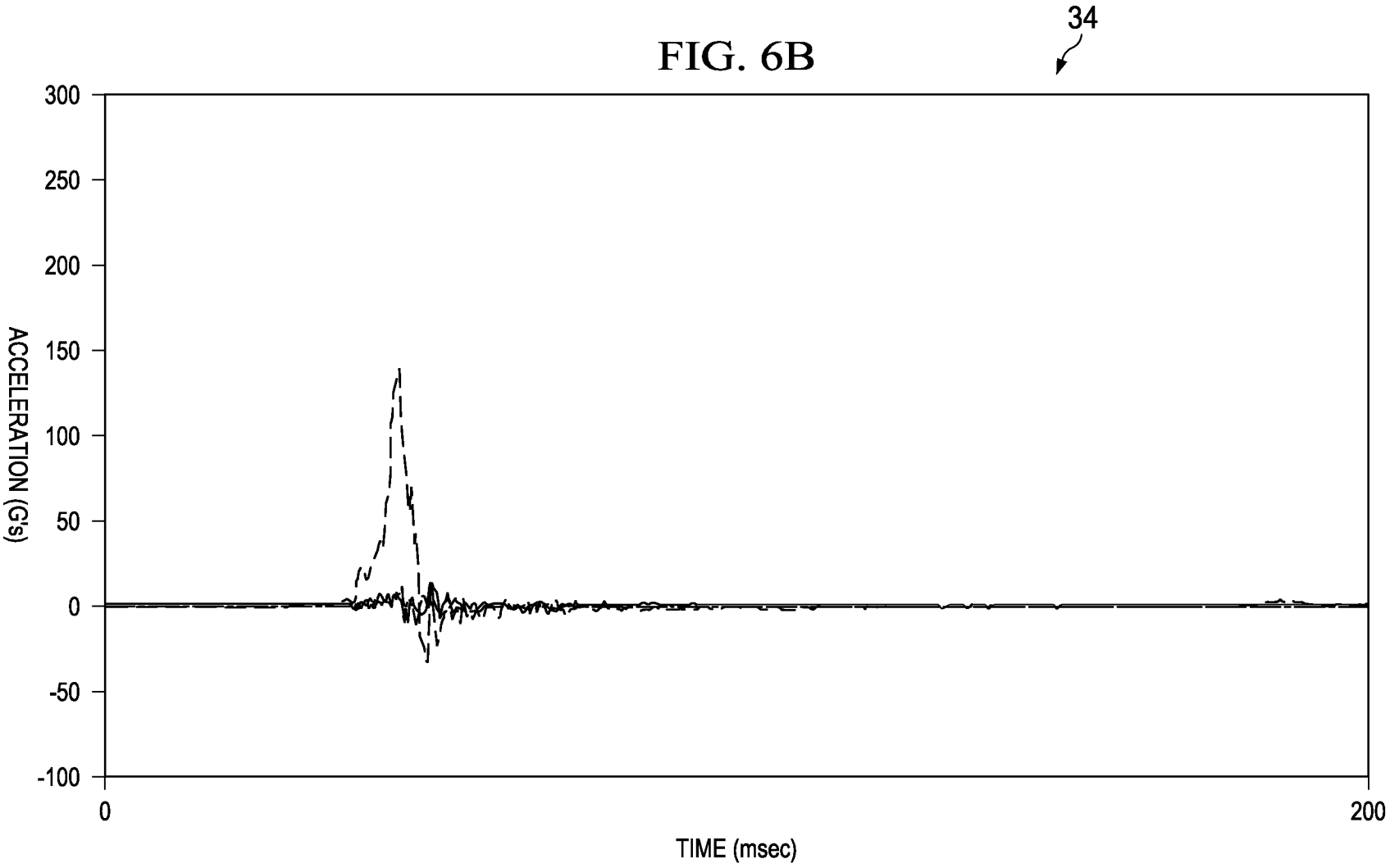

Referring now to FIG. 6, an example is depicted of a support 14 having tabbed feet 30 and symmetrical perforations 38 at the perimeter of a supported device, and the acceleration response at the support surface 16. Voids 36 are cut to a greater depth to define 10 contact points when tabs 30 are folded into feet. Perforation 38 is cut in a rectangular shape that has a perimeter of substantially that of the information handling system that rests on support surface 16. The precise relationship of the size of the perimeter of perforation 38 relative to the size of information handling system 10 may vary based on test results. In one embodiment, information handling system 10 has a smaller perimeter than that of perforations 38; in alternative embodiments, the perimeters are the same size or the perimeter of information handling system 10 is greater than the perimeter of perforations 38. A diagonal score 40 is added at each corner of support surface 16 inwards to perforation 38 to further enhance dynamic action of support surface 16 in response to accelerations. As is depicted by acceleration chart 34, the introduction of enhanced voids 36, perforations 38 and diagonal scores 40 reduce the maximum acceleration experienced by information handling system 10 to approximately 140 G's.

Figure 7:
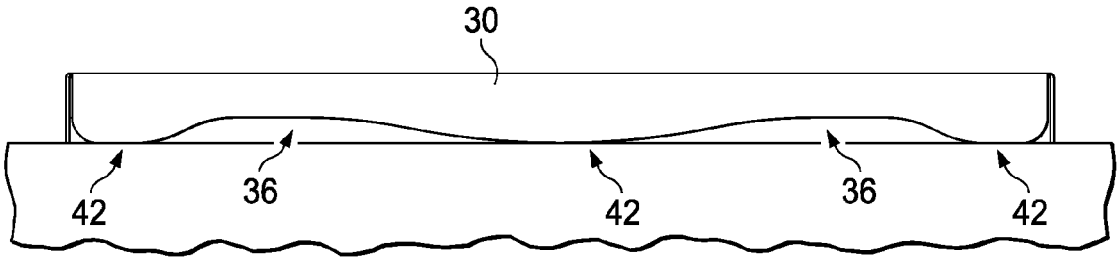
FIG. 7 depicts a side view of tabbed feet with voids to adopt a desired acceleration response.

Referring now to FIG. 7, a side view depicts tabbed feet 30 with voids 36 to adopt a desired acceleration response. A contact point 42 is established between each void 36 to contact the bottom (or top) of container 12. The depth of each void may vary to achieve constant acceleration across support surface 16. Similarly, cuts may be added along the score that forms tab 30 to achieve a desired cushion effect. Other types of alterations may include the use of more voids and feet spaced in symmetrical or unsymmetrical patterns.

Figure 8A:
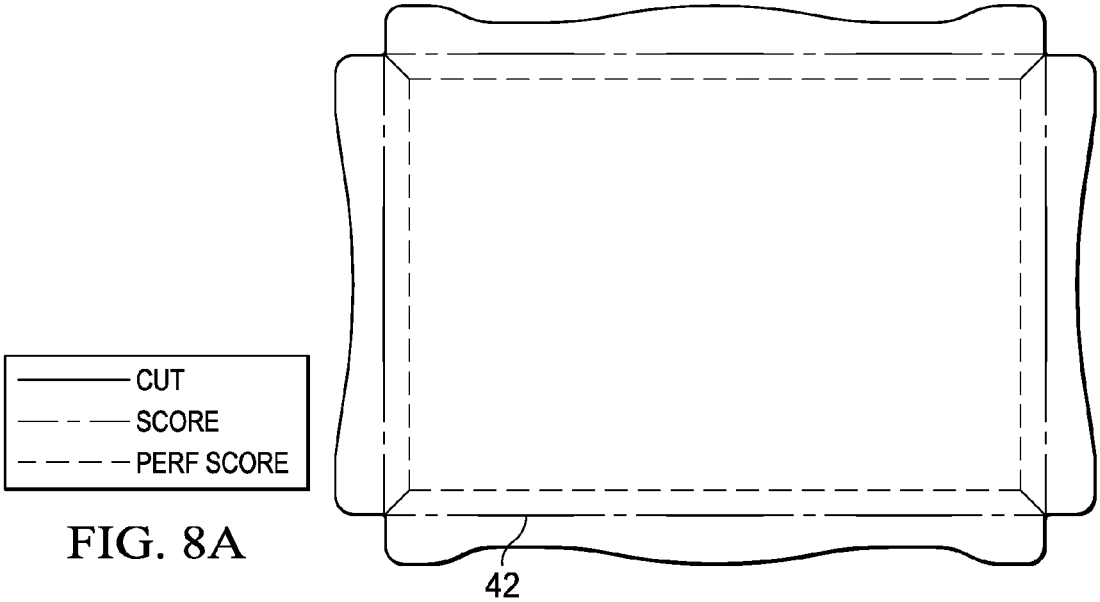
FIGS. 8A and 8B (generally referred to herein as FIG. 8) depict a support having perforation cuts along a tabbed feet bend and the acceleration response at the support.
Figure 8B:
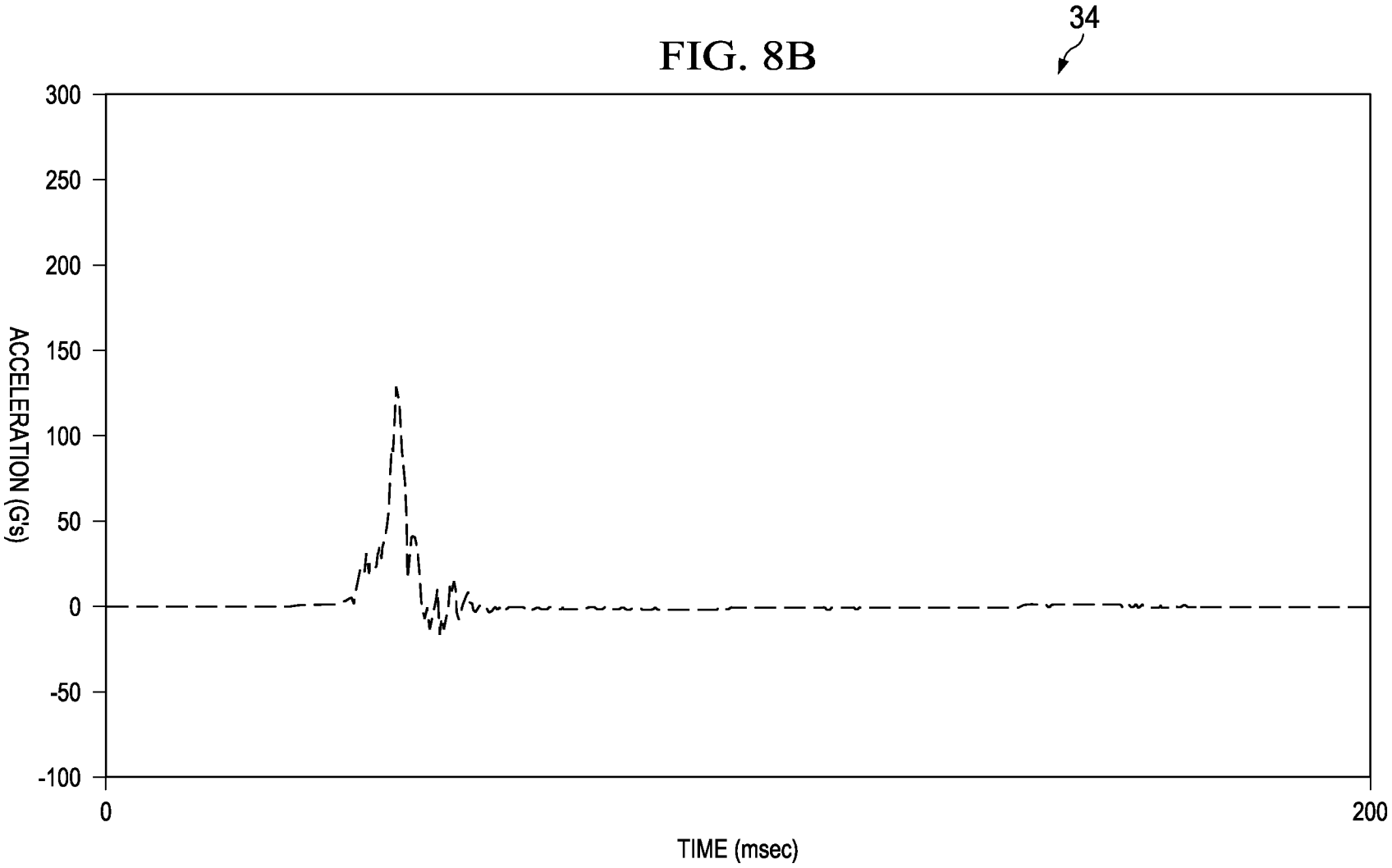

Referring now to FIG. 8, an example is depicted of a support having perforation cuts along a tabbed feet bend and the acceleration response at the support. The score 32 that forms tabs 30 has cuts 42 added along its length. Three cuts are made along each long side of the rectangular shape and one longer cut is made along each short side of the rectangular shape. The cuts 42 aid in distribution of acceleration forces as a constant across support surface 16. In alternative embodiments, perforations may be added along all or parts of the score 32. As is depicted by acceleration chart 34, adding cuts to the score reduces the maximum acceleration experienced by the information handling system to approximately 125 G's.

Figure 9A:
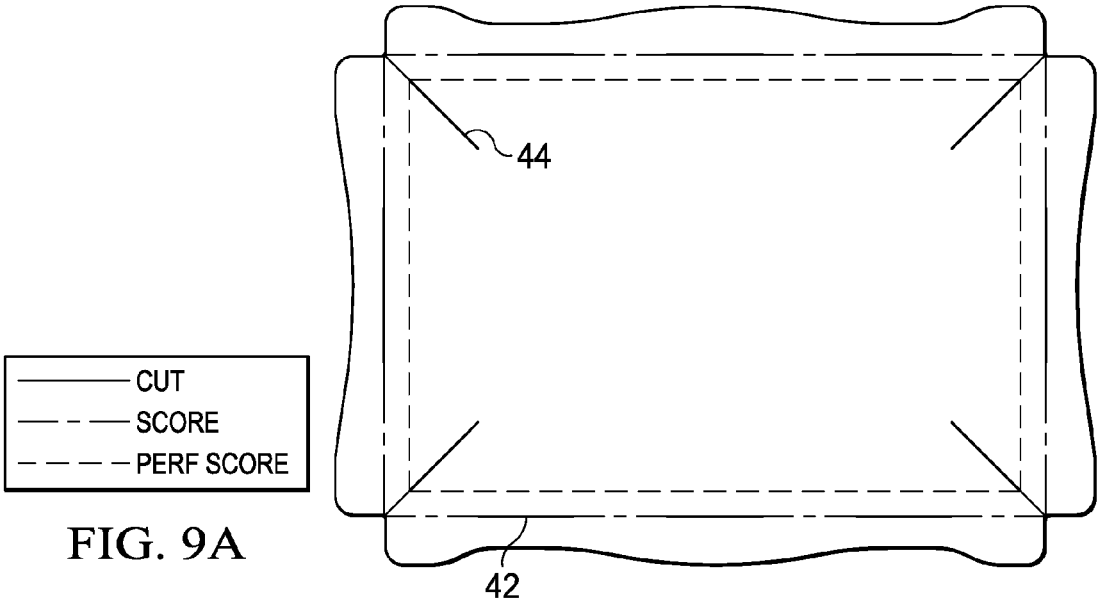
FIGS. 9A and 9B (generally referred to herein as FIG. 9) depict a support having diagonal perforation cut lines and the acceleration response at the support.
Figure 9B:
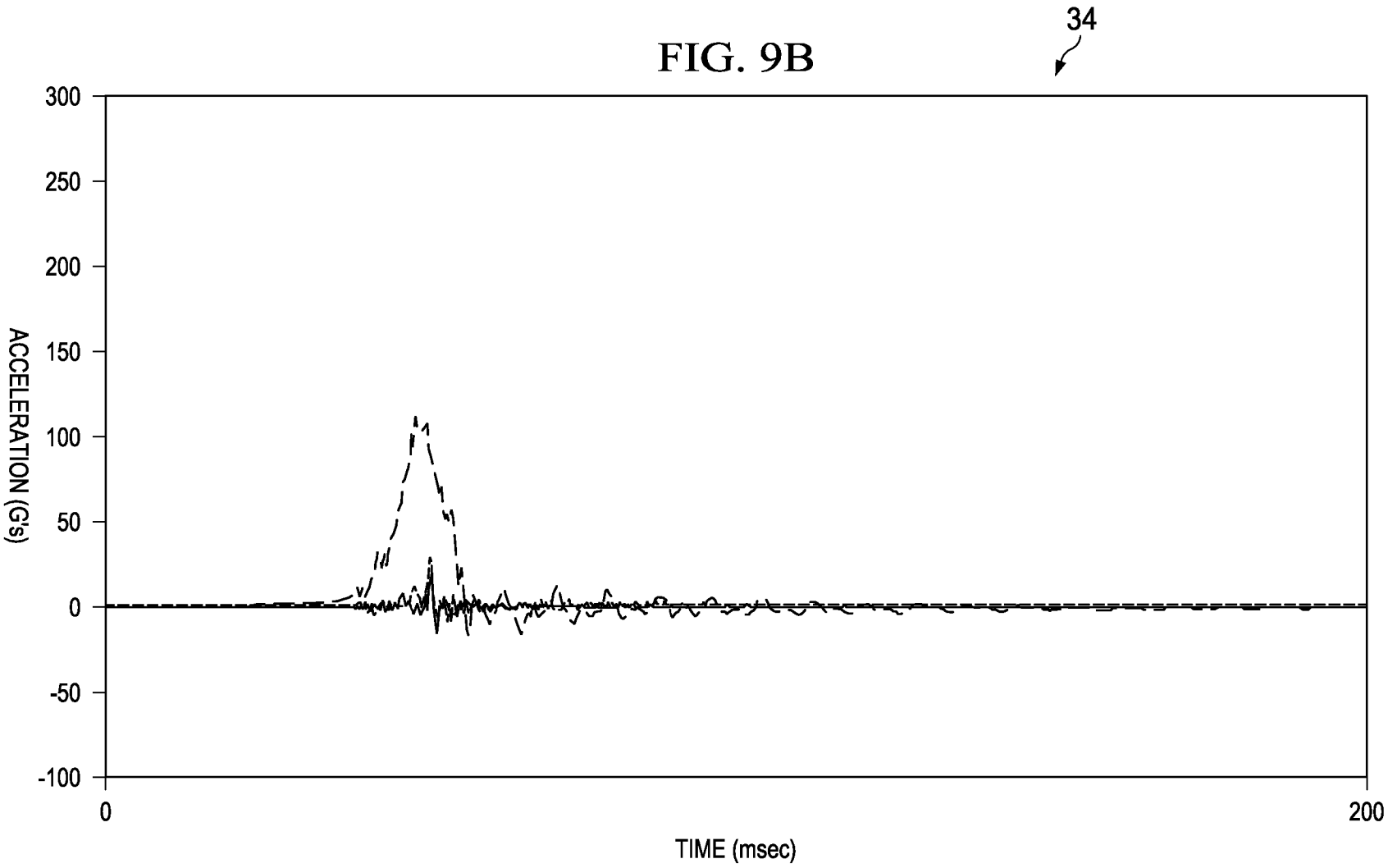

Referring now to FIG. 9, an example is depicted of a support having diagonal perforation cut lines 44 and the acceleration response at the support surface 16. Cut lines 44 are each a straight cut that extends from each corner of the rectangular perforation 38 towards a central position of support surface 16. The length of each cut 44 may vary to achieve a desired cushion effect. In an alternative embodiment, multiple diagonal cuts 44 may be made at each corner with varying angles towards the center of support surface 16. In other alternative embodiments, perforations may be used instead of cuts or cuts 44 may extend to include the scored area 42. As is depicted by acceleration chart 34, the addition of diagonal cuts 44 further decreases the maximum acceleration at information handling system 10 to slightly more than 100 G's.

Figure 10:
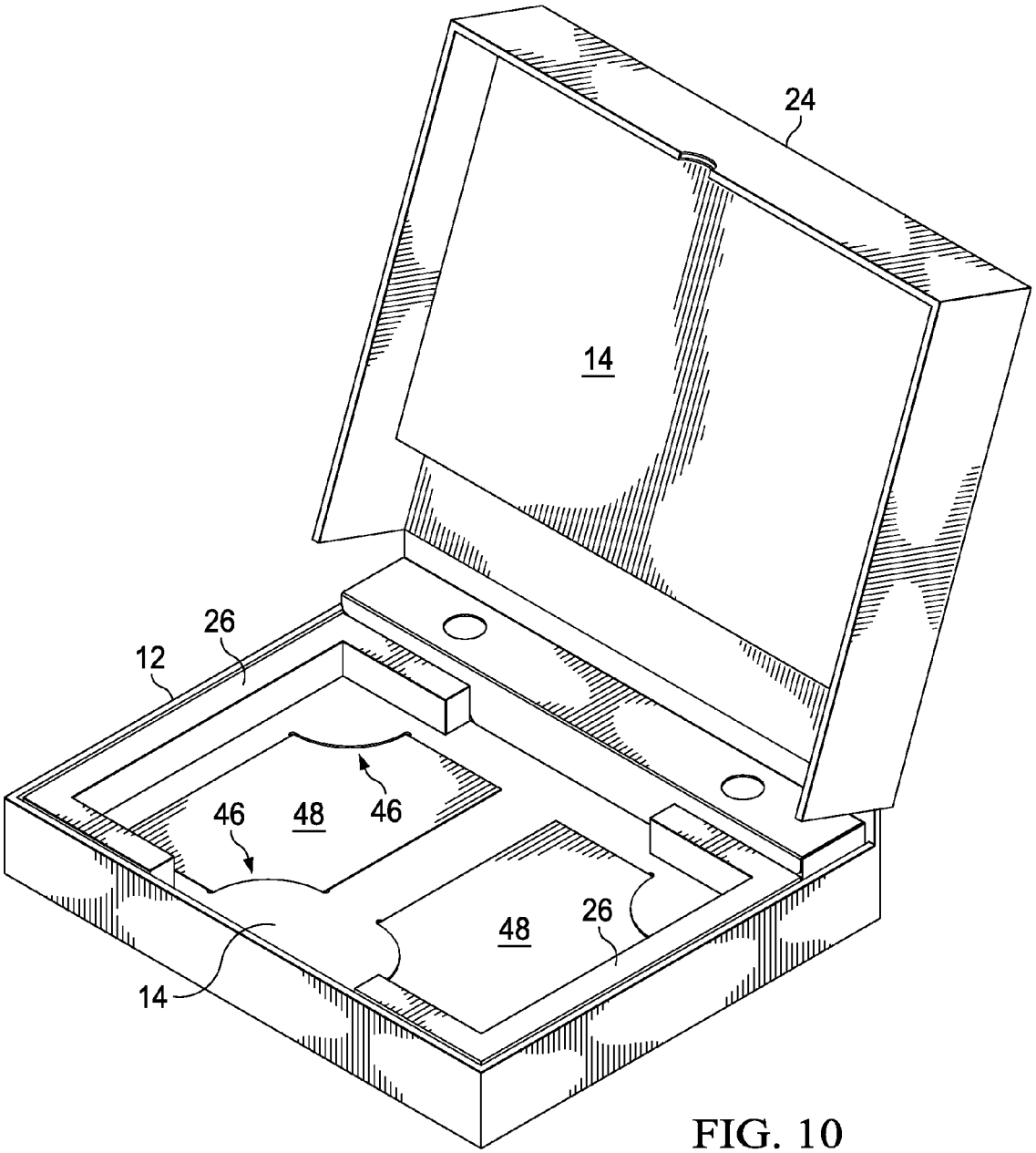
FIG. 10 depicts an upper perspective view of a container prepared to accept an information handling system.

Referring now to FIG. 10, an upper perspective view depicts a container 12 prepared to accept an information handling system 10. In the example embodiment, support surface 16 has slits 46 that accept documentation 48 for delivery with the package, such as user manuals. Foam 26 rests against the container 12 so that the information handling system will stay stationary in a desired position that has cushioning. A negative edge built into container 12 allows storage of hardware, such as a power adapter. In one embodiment, support 14 has one or more tab feet integrated with container 12.

Figure 11:
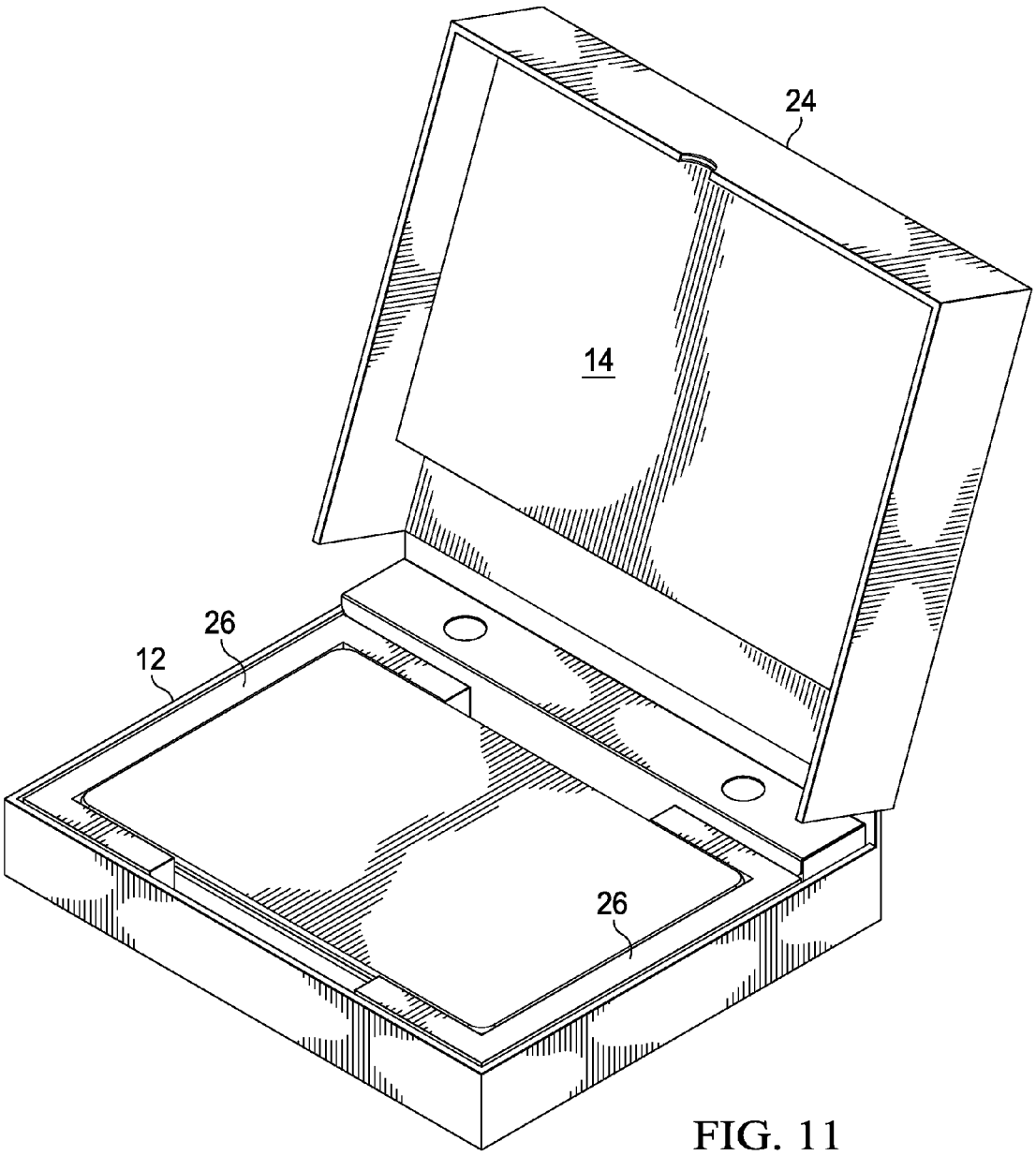
FIG. 11 depicts an upper perspective view of the container having an information handling system.

Referring now to FIG. 11, an upper perspective view depicts the container 12 having an information handling system 10. Foam 26 secures information handling system 10 from movement. An upper support 14 couples to a lid 24 of container 12 so that an upper support surface 26 presses against information handling system 10. Sandwiching information handling system 10 between upper and lower supports 14 aids in maintaining a constant acceleration across information handling system 10. Each of the upper and lower supports 14 may be tuned with its own features based upon expected accelerations and to cooperate with each other for dampening acceleration forces.

Although the present invention has been described in detail, it should be understood that various changes, substitutions and alterations can be made hereto without departing from the spirit and scope of the invention as defined by the appended claims.

What is claimed is:

1. A system for packaging a product, the product having a perimeter, the system comprising:

an outer packaging material enclosing the product between an upper surface and a lower surface;

first and second support surfaces formed from corrugated material and held elevated between the upper surface and the lower surface, the first and second support surfaces each having a perforation formed substantially at the product perimeter, the support surface providing a flat surface across the perforations, each of the first and second support surfaces having bent tabs along a periphery, the tabs bent substantially perpendicular to the support surface to define feet that elevate the support surface, the tabs having indented portions that do not contact the outer packaging material; and a positioning device operable to maintain the product in a position at the perforation;

wherein the product is disposed between the first and second support surfaces so that accelerations applied to the product translate through the perforation to the tabs where the tabs contact the outer packaging material.

2. The system of claim 1 wherein the product perimeter has a rectangular shape, the perforation has a rectangular shape with a perimeter greater than the product perimeter, and the support surface further having a cut formed at each corner of the perforation, each cut extending from the perforation corner diagonally outwards towards the outer packaging material, the cut passing completely through the support surface for a contiguous distance.

3. The system of claim 2 wherein the support surface further has a cut formed at each corner of the perforation, each cut extending from the perforation corner diagonally inwards towards a center position of the perimeter, the cut passing completely through the support surface for a contiguous distance.

4. The system of claim 1 wherein the positioning device further comprises a cushion disposed between the outer packaging material and the perimeter.

5. The system of claim 1 wherein the product is a portable information handling system that rests on the support surface.

6. A method for forming a product package to contain a product, the method comprising:

forming a container having an upper surface and a lower surface and having an interior and an exterior;

cutting first and second support surfaces from corrugated paper, each support surface having a rectangular shape with a tab formed along each side, the tabs folding perpendicular to the support surface to form feet that raise the support surface relative to the lower and upper surfaces, the feet contacting the container at contact portions, the feet having voids disposed between the contact portions, the voids not contacting the container;

perforating a rectangular shape in each support surface to have a perimeter of substantially the same size as the product; and maintaining a product position on the first and second support surfaces, the product position substantially at the perforated rectangular shape and disposed between the first and second support surfaces so that accelerations applied to a product placed at the product position pass through the first and second support surface perforations to the feet contact portions.

7. The method of claim 6 further comprising perforating in each of the first and second support surfaces from each corner of the perforated rectangular shape outward towards the container exterior.

8. The method of claim 6 further comprising perforating in each of the first and second support surfaces from each corner of the perforated rectangular shape inward toward a center position of the container interior.

9. The method of claim 6 wherein cutting a support surface further comprises perforating at least a portion of the support surface along the folding position of the tabs.

10. The method of claim 6 wherein maintaining a product position further comprises disposing cushioning between the container exterior and the perforated rectangular shape.

11. A method for forming product support surfaces to support a product in a shipping container, the method comprising:

cutting the product support surfaces from first and second pieces of corrugated paper;

scoring tabs along side edges of the product support surfaces;

bending the tabs to form feet that elevate an interior portion of the product support surface relative to a bottom support surface, the feet formed along the full periphery of the support surface and having voids that define contact regions, the contact regions sized to contact the shipping container so that the voids do not contact the shipping container;

perforating the interior portion with at least one symmetrical pattern that allows deflection of the interior portion in response to a transverse acceleration; and disposing the first and second product surfaces on opposing surfaces of the product with the product between the first and second product support surfaces so that accelerations acting on the product translate through the support surface perforations to the contact regions.

12. The method of claim 11 wherein perforating the interior portion with at least one symmetrical pattern further comprises perforating a shape within the interior portion having a perimeter substantially that of the product.

13. The method of claim 12 wherein perforating the interior portion with at least one symmetrical pattern further comprises perforating a line from each of the corners of the side edges across the perforated shape towards a central position of the interior portion.

* * * * *